United States Patent [19]

Lee et al.

[11] Patent Number: 4,628,568

[45] Date of Patent: Dec. 16, 1986

[54] FRICTION TYPE HOLD OPEN MECHANISM

[75] Inventors: Michael C. Lee, Troy; Daniel F. Raubinger, Sterling Heights; Peter L. Swanney, Bloomfield Hills, all of Mich.

[73] Assignee: General Motors Corporation, Detroit, Mich.

[21] Appl. No.: 761,422

[22] Filed: Aug. 1, 1985

[51] Int. Cl.[4] ..... E05D 11/08

[52] U.S. Cl. ..... 16/337; 16/341

[58] Field of Search ..... 16/319, 327, 337, 341, 16/352, 362–364, 385, DIG. 13; 118/624; 427/25, 27, 32

[56] References Cited

U.S. PATENT DOCUMENTS

| | | | |
|---|---|---|---|
| 2,882,548 | 4/1959 | Roethel | 16/86 R |
| 2,992,451 | 7/1961 | Schonitzer et al. | 16/327 |
| 3,345,680 | 10/1967 | Slattery | 16/337 |
| 3,461,481 | 8/1969 | Bachmann | 16/341 |
| 3,584,333 | 11/1972 | Konishi | 16/385 |
| 4,325,982 | 4/1982 | Gillette et al. | 118/624 |
| 4,450,954 | 5/1984 | O'Connell | 118/624 |

FOREIGN PATENT DOCUMENTS

| | | | |
|---|---|---|---|
| 1915750 | 10/1970 | Fed. Rep. of Germany | 16/337 |

*Primary Examiner*—M. Jordon

*Attorney, Agent, or Firm*—Patrick M. Griffin

[57] ABSTRACT

A vehicle door hold open mechanism of the friction type may be assembled to the vehicle prior to the vehicle being subjected to an electrostatic priming process without coating the critical metal surfaces with primer. An arm member secured to the door includes non-conductive frictional material molded in a two sided arc. A pair of metal blocks engagable with the frictional material to create a frictional force are insulated from the vehicle body by elastomer blocks. When the door is opened, the frictional material slides between the metal blocks, compressing them to create a frictional hold open force. Neither the metal blocks, nor the frictional material, will receive a coating of primer during the priming process, as they will be insulated from the electrostatic charge received by the vehicle door and body.

3 Claims, 6 Drawing Figures

FRICTION TYPE HOLD OPEN MECHANISM

This invention relates to hold open mechanisms generally and specifically to a friction type hold open mechanism that can be assembled to a vehicle prior to the vehicle being coated by an electrostatic charge process.

BACKGROUND OF THE INVENTION

There are several known types of hold open mechanisms designed to retain a hinged vehicle door in a hold open position. One type of hold open mechanism provides a frictional force to retain a vehicle door in at least one, and often several, hold open positions. The frictional hold open force is commonly generated by a metal surface sliding relative to a frictional material that has both a high static coefficient of friction and a low sliding coefficient of friction, such as nylon or polyurethane. This cooperation of a metal surface and a frictional material gives both a good frictional force and good wear characteristics. The most common structure for such a friction type mechanism, therefore, includes a metal member, such as an arm or strap, joined to either the vehicle body structure or the door. As the door is opened or closed, the surface of the metal member slides relative to frictional material on a friction member that is joined to the door or the body structure. The frictional material and the metal member are often resiliently engaged together to enhance generation of the frictional force. Often, the metal member is designed to be engaged by the friction member over all, or a substantial portion, of the range of motion of the door. Such a friction type hold open is generally referred to as an infinite position hold open because it has the potential to retain the door in a theoretically infinite number of hold open positions. Friction type hold open mechanisms of the type discussed above are disclosed in the U.S. Pat. Nos. 3,345,680 to Slattery, 2,882,548 Roethel, 3,584,333 Hakala, and 2,992,451 Schonitzer. A similar mechanism is disclosed in the patent to Bachmann U.S. Pat. No. 3,461,481, although it shows metal frictionally rubbing directly on metal.

With any of these structures, a problem is presented with modern assembly and painting processes. Coating the metal vehicle body structure and door with primer is best done by a process in which the surfaces of these parts are given an electrostatic charge. It is also desirable that all structures to be secured to the body structure and door be so secured before the priming process. Essentially any metal that may be practically used and fabricated will be electrically conductive. The hold open mechanisms described above would, therefore, if secured to the body structure and door before the priming process, also receive a coating of primer on the metal surfaces that engage the frictional material. Such a coating would have to be removed to regain the necessary frictional characteristics, a potentially time consuming and expensive assembly step. Providing insulators between the metal metal member and vehicle body structure or door would be more costly, as well as impractical. The most secure attachment will generally involve metal contacting metal at some point, which is conductive.

SUMMARY OF THE INVENTION

The subject invention provides a friction type hold open mechanism that may be assembled to an electrically conductive vehicle body structure and door prior to a coating process using an electrostatic charge.

A vehicle includes a body structure and a door, both formed of steel or some similarly electrically conductive material. The door is mounted to the body structure by a pair of pivoted hinge straps, and is releasably held in a plurality of hold open positions by the invention. The invention includes an arm member securable to the door with a surface of non-conductive frictional material, a non-conductive resilient member securable to the body structure, and a metal block secured to the resilient member to engage the frictional material. These elements cooperate to give a frictional hold open force, as well as to insulate the friction producing surfaces from electrostatic charge, without the use of any separate insulating structures.

In the embodiment disclosed, the arm member is generally arcuate in shape and secured to the door mounted hinge strap. The arm member has a metal core to which frictional material of an electrically non-conductive polymer is injection molded. Injection molding the frictional material allows it to be easily formed with the optimal configuration and length to cooperate with other structure of the hold open mechanism, described further below. The frictional material is formed with two opposed sides disposed in an arc defined about the hinge axis of the door and tapering together to a wedge shaped tip.

A housing securable to the body structure mounted hinge strap includes a pair of opposed elastomer blocks therewithin. A pair of metal blocks are secured to the elastomer blocks, also in opposed relation and spaced apart a distance less than the thickness of the frictional material on the arm member. As the door begins to open, the tip of the molded frictional material slides between the opposed metal blocks, parting them further and compressing the elastomer blocks. The frictional material is formed with the optimal taper to smoothly part the blocks, and with the optimal length to do so at the point in the door opening motion where a hold open force is desired. As the door continues to open, the opposed sides of frictional material slide along the metal blocks. The metal blocks are resiliently biased into the frictional material by the compressed elastomer blocks, which are compressed an amount determined by the thickness of the frictional material. At any open position of the door where the frictional material of the arm member and the metal blocks are so engaged, the desired frictional hold open force will be provided to retain the door in position.

The frictional material is non-conductive, and will not be coated in the coating process. The resilient member provided by the elastomer blocks is also non-conductive. The metal blocks are thereby also effectively insulated from the door, without the use of any separate insulating structure. The hold open mechanism of the invention may, therefore, be completely assembled to the vehicle body structure and door prior to an electrostatic coating process, without subjecting the friction producing surfaces to coating.

It is, therefore, a broad object of the invention to provide a friction type hold open mechanism for a vehicle or the like including an electrically conductive body structure and door hingedly mounted thereto that may be assembled to the body structure and door prior to a coating process involving an electrostatic charge, without the use of any separate insulating structures or subsequent steps to remove the coating from the friction producing surfaces.

It is another object of the invention to provide a hold open mechanism of the type described that comprises an arm member securable to either the body structure or door including a non-conductive frictional material, and an electrically non-conductive resilient member securable to the door or the body structure with a metal block secured thereto so as to engage the frictional material and compress the resilient member to create a frictional hold open force, with the resilient member also acting to insulate the metal block so that the hold open mechanism may be so assembled to the vehicle prior to the electrostatic coating process.

It is a further object of the invention to provide a hold open mechanism of the type described in which the metal block and frictional material of the arm member are engagable at every relative position of the arm member and block so as to retain the door in an infinite number of hold open positions.

It is yet another object of the invention to provide a hold open mechanism of the type described in which the arm member has electrically non-conductive frictional material molded thereto so as to have the optimal configuration and length for engaging the metal block to create the desired frictional hold open force.

It is still another object of the invention to provide a friction type door hold open mechanism for a vehicle or the like that has an electrically conductive body structure and door, that can be assembled to the vehicle prior to the vehicle being coated by a process involving an electrostatic charge, that includes an arm member securable to either the body structure or the door and movable relative to the other thereof as the door is moved to a hold open position and that includes an electrically non-conductive frictional material, an electrically non-conductive resilient member securable to either the door or the body structure with a metal block secured to the resilient member so as to be electrically insulated thereby and to engage the frictional material so as to compress the resilient member and be biased into the frictional material to create a frictional hold open force between the arm member and metal block to retain the door in a hold open position, the non-conductive frictional material and resilient member allowing the hold open mechanism to be so assembled to the vehicle prior to being so coated.

DESCRIPTION OF THE PREFERRED EMBODIMENT

These and other objects and features of the invention will appear from the following written description and drawings, in which.

Figure 1:
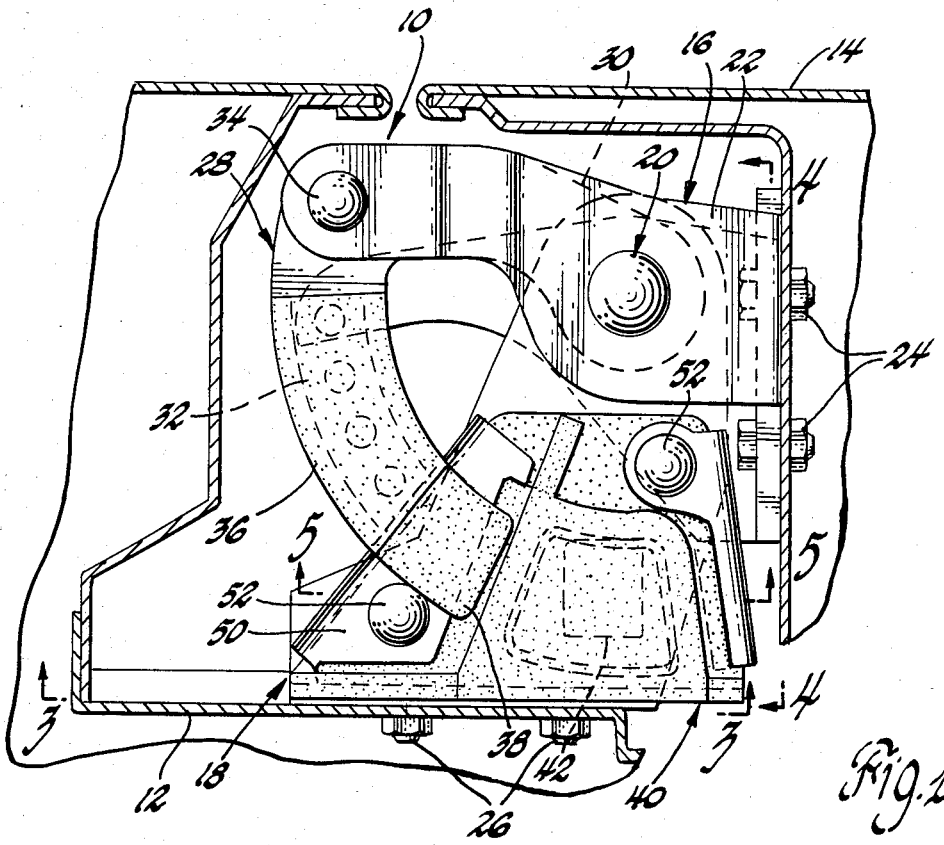
FIG. 1 is a plan view of the hold open mechanism of the invention with the body structure and door shown in cross section and the door in closed position.

Referring first to FIG. 1, the preferred embodiment of the hold open mechanism of the invention, designated generally at 10, is shown assembled to a vehicle body structure, 12, and vehicle door, 14. Hold open mechanism 10 may be used in any location, but is disclosed for use with a passenger side door. The body structure 12 and door 14 are illustrative only, and may have any desired configuration. However, thev will generally be formed of steel or other electrically conductive material. Consequently, door 14 and body structure 12 will be most conveniently coated, as with primer, by a process in which they are given an electrostatic charge of one pole to attract oppositely charged molecules of primer. This process is often referred to as the ELPO process. The use of such a process would present a problem with conventional friction type hold open mechanisms if they were assembled prior to the priming process. Securing such a hold open mechanism to the body structure 12 and door 14 prior to the priming process would subject it to an electrostatic charge as well. As described above, a friction type hold open mechanism generally includes a metal member the surface of which is involved in generating the frictional hold open force. It is important that that surface either be kept clean of primer, or cleaned later. The hold open mechanism of the invention keeps the critical metal surfaces clean of primer without the use of any separate insulators or subsequent cleaning steps.

Figure 2:
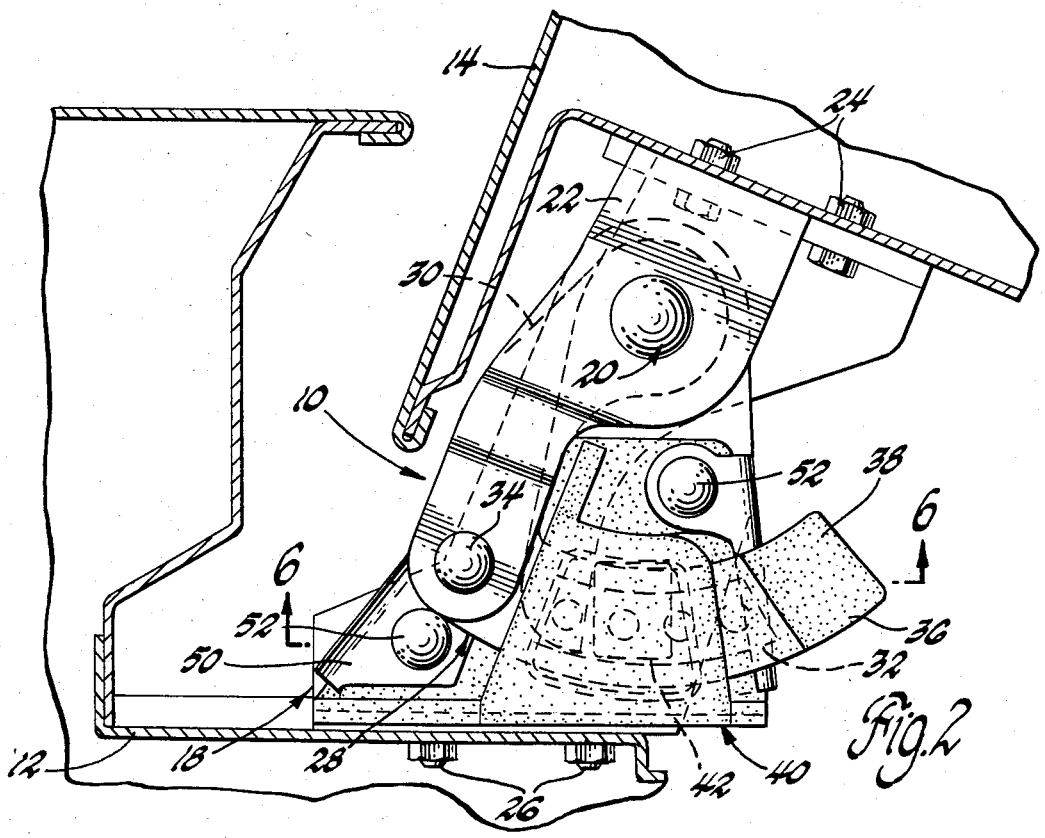
FIG. 2 is a view similar to FIG. 1, but with the door in a hold open position.
Figure 3:
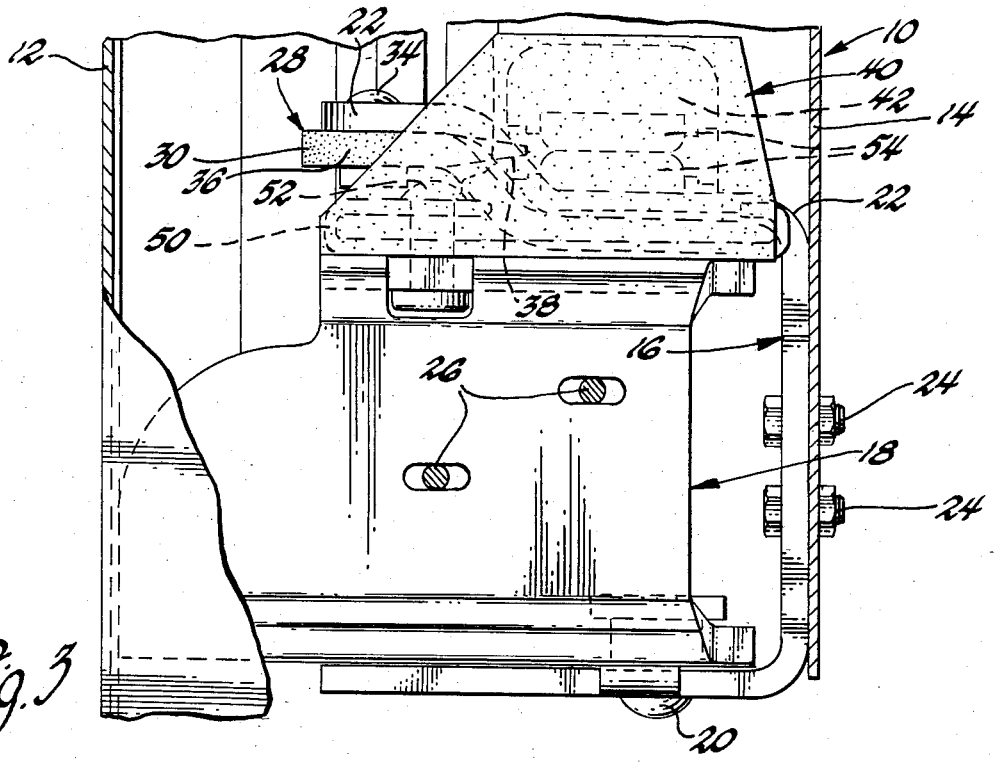
FIG. 3 is a view taken along the line 3—3 of FIG. 1 with the body structure partially broken away.
Figure 4:
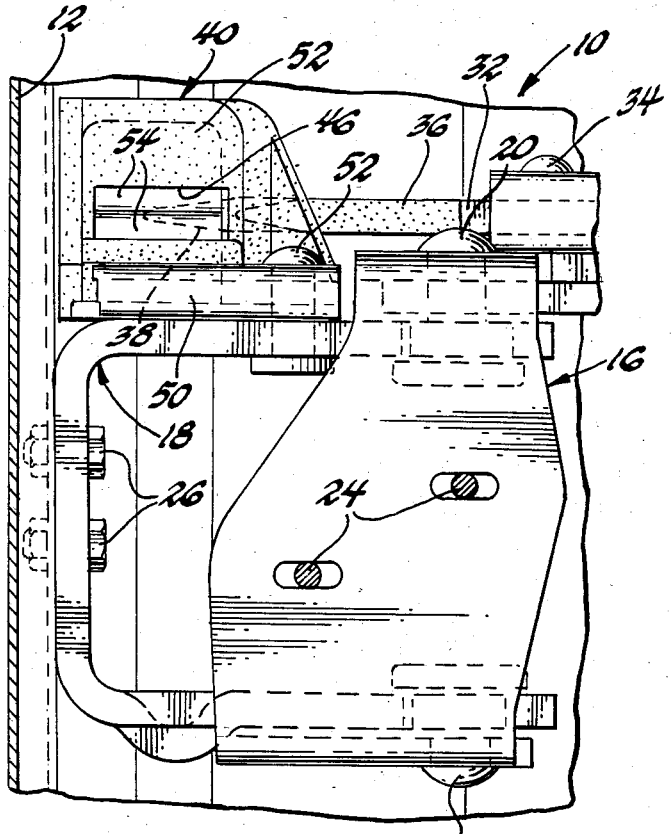
FIG. 4 is a view taken along the line 4—4 of FIG. 1.

Referring next to FIG. 3, door 14 is mounted to body structure 12 by a pair of hinge straps, a door mounted hinge strap designated generally at 16 and a body mounted hinge strap designated generally at 18. Hinge straps 16 and 18 are generally U-shaped, and are pivotally connected by a pair of coaxial pivot assemblies 20, the lower one of which is visible. Hinge straps 16 and 18 allow door 14 to be swung open in conventional fashion, as from the closed position of FIG. 1 to one of the possible hold open positions, FIG. 2. Still referring to FIG. 3, hinge strap 16 includes a top leg 22 which is offset to accommodate other structure described below. Hinge straps 16 and 18 are conventionally secured to door 14 and body structure 12 by nut and bolt assemblies 24 and 26, respectively. Hinge straps 16 and 18 could be secured by any suitable means, such as welding. However, a sufficiently rigid securement will generally involve metal to metal contact. Therefore, hinge straps 16 and 18, as well as any metal structures secured thereto, will be subject to the same electrostatic charge to which body structure 12 and door 14 are subjected.

Referring next to FIGS. 1 and 3, an arm member designated generally at 28 and formed of stamped steel includes a mounting portion 30 that matches the shape of top leg 22 and a generally arcuately shaped core 32. Arm member 28 is secured to door 14 by fixing mounting portion 30 beneath top leg 22 by the top one of the pivot assemblies 20 and by a rivet 34. A frictional material 36 is injection molded about core 32, which is drilled or otherwise relieved to enhance the bond, prior to securing arm member 28. Frictional material 36 is a polymer mix, with a base of nylon, although other suitable polymers may be substituted. Any polymer mix used should have a high enough static coefficient of friction to create a desired frictional hold open force in cooperation with other structure to be described, as well as a low enough coefficient of friction to allow door 14 to be moved without excessive effort. The details of frictional material 36 do not concern the invention disclosed here, but, significantly, it will be non-conductive. Thus, frictional material 36 will not be subject to an electrostatic charge, and will not receive a primer coating in the priming process.

Making arm member 28 a composite metal-polymer structure provides other advantages. The frictional material 36 may be easily formed with the optimal length and configuration for engaging other structure to be described below. For the embodiment 10 disclosed, that shape is generally an arc defined about the pivot axis of hinge straps 16 and 18. The frictional material 36 is formed with two generally flat opposed sides that taper to a wedge shaped tip 38, FIG. 5, and which may also be given a constant taper from the radially inner to the radially outer edge, if desired. So molding the frictional material 36 allows its configuration and length to be varied, for the same core 32, much more easily than with grinding or otherwise shaping an entirely metal member.

Figure 5:
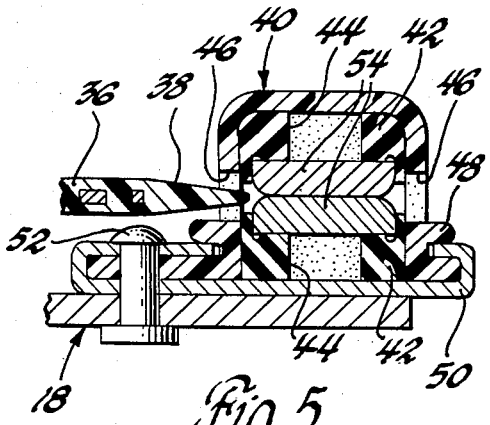
FIG. 5 is a sectional view taken along the line 5—5 of FIG. 1.

Referring next to FIGS. 1 and 5, a molded plastic housing 40 has two opposed elastomer blocks 42 mounted therewithin. Each elastomer block 42 has a central relieved portion 44 into which it may expand when compressed, as described below. Two openings 46 in housing 40 give access between elastomer blocks 42. The elastomer for blocks 42 is chosen to be suitably resilient and temperature insensitive, and, significantly, is electrically non-conductive. Housing 40 includes a grooved base 48 over which a metal retainer 50 is slide fitted. Retainer 50 is then fixed by rivets 52 to body mounted hinge strap 18, and thereby to body structure 12. Retainer 50 is necessary to assure a good metal to metal contact in securing the housing 40 and elastomer blocks 42 to the body mounted hinge strap 18. Housing 40 is made of plastic basically for weight and cost reasons, and could as easily be made of metal, which would eliminate the need for retainer 50. It is not crucial, for purposes of the invention, that housing 40 be made of a non-conductive material, or that it even be present, since elastomer blocks 42 could be secured to body structure 12 by some other means.

Referring to FIG. 5, a pair of metal blocks 54 are secured to the opposed elastomer blocks 42. Metal blocks 54 are thereby opposed and are lightly touching when door 14 is closed. Metal blocks 54 are made of chrome plated steel, and are electrically conductive. By being so secured to the elastomer blocks 42, metal blocks 54 are electrically insulated from body mounted hinge strap 18 and body structure 12. Therefore, it may be easily understood that the entire hold open mechanism 10 may be assembled to door 14 and body structure 12 without subjecting metal blocks 54 or frictional material 36 to an electrostatic charge or a primer coating. This advantage results from the particular arrangement and materials of metal blocks 54 and frictional material 36 alone, without any separate insulating structures. These same structural elements also cooperate to provide the desired frictional hold open force, as described next.

Figure 6:
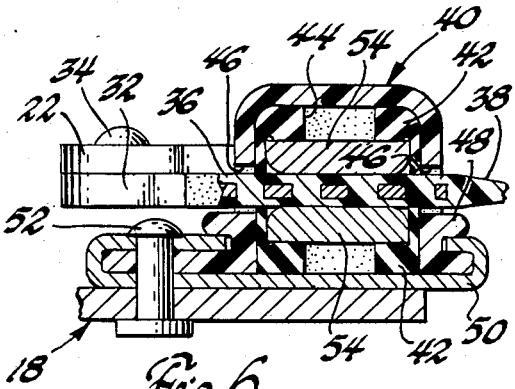
FIG. 6 is a sectional view taken along the line 6—6 of FIG. 2.

Still referring to FIGS. 1 and 5, when door 14 is in the closed position, the tip 38 of the frictional material 36 will be spaced away from the metal blocks 54. As door 14 begins to open from the FIG. 1 closed position toward the FIG. 2 hold open position, tip 38 will move toward the metal blocks 54 and through the first opening 46, FIG. 5. As the door 14 continues to move, tip 38 will pass between blocks 54, parting them, compressing elastomer blocks 42, and sliding the sides of the frictional material 36 along metal blocks 54, FIG. 6. As mentioned, frictional material 36 may be easily molded with the best taper for smoothly parting the metal blocks 54, and with the proper length to part them at just the point in the opening of door 14 where a hold open force is desired. The compressed resilient elastomer blocks 42 force the metal blocks 54 into the frictional material 36 to produce a frictional hold open force between the arm member 28 and metal blocks 54 at any relative position thereof. The amount of compression of elastomer blocks 42 may also be easily varied at any point by varying the thickness of the frictional material 36. The arcuate shape in which the frictional material 36 is formed assures that it will remain slidably engaged with metal blocks 54 once they are parted. Door 14 is thus releasably retained in the hold open position of FIG. 2, or any position where the frictional material and metal blocks 54 are so engaged, a theoretically infinite number of hold open positions.

Therefore, a friction type hold open mechanism that may be assembled to the vehicle prior to an electrostatic priming process has been provided. Other structures are possible. The arm member could be straight, and pivotally secured to one of the hinge straps. It would be drawn between a pair of similarly arranged metal blocks as the door opened, and would also provide the basic advantages of the invention. Other frictional materials and non-conductive resilient members with similar properties could be substituted for those disclosed. It will be understood, therefore, that the invention is capable of embodiments within the scope of the invention other than those disclosed and is not intended to be so limited.

The embodiments of the invention in which an exclusive property or privilege is claimed are defined as follows:

1. A friction type door hold open mechanism for a vehicle or the like having an electrically conductive body structure for retaining an electrically conductive door or the like hingedly mounted to said body structure in a hold open position, said mechanism being capable of being assembled to said body structure and door prior to said body structure and door being coated by a process in which said body structure and door are subjected to an electrostatic charge, comprising;

an arm member adapted to be secured to one of said body structure and door and movable relative to the other of said body structure and door as said door is moved to said hold open position, said arm member further including a frictional material that is electrically non-conductive, an electrically non-conductive resilient member adapted to be secured to the other of said body structure and door, and, a metal block secured to said resilient member and engagable with said frictional material on said arm member so as to compress said resilient member when said arm member moves relative to the other of said body structure and door, said compressed resilient member thereby acting both to electrically insulate said metal block from the other of said body structure and door and to engage said metal block under force with said frictional material to create a frictional force between said arm member and metal block, whereby, said arm member, resilient member and metal block cooperate to provide a frictional hold open force to retain said door in a hold open position, while said non-conductive frictional material and resilient member also cooperate to insulate said hold open mechanism from electrostatic charge to allow it to be assembled to said body structure and door prior to being coated.

2. A friction type door hold open mechanism for a vehicle or the like having an electrically conductive body structure for retaining an electrically conductive door or the like hingedly mounted to said body structure in an infinite number of hold open positions, said mechanism being capable of being assembled to said body structure and door prior to said body structure and door being coated by a process in which said body structure and door are subjected to an electrostatic charge, comprising;

an arm member adapted to be secured to one of said body structure and door and movable relative to the other of said body structure and door as said door is moved to said hold open positions, said arm member further including a frictional material that is electrically non-conductive, an electrically non-conductive resilient member adapted to be secured to the other of said body structure and door, and, a metal block secured to said resilient member and engagable with said frictional material on said arm member so as to compress said resilient member when said arm member moves relative to the other of said body structure and door, said compressed resilient member thereby acting both to electrically insulate said metal block from the other of said body structure and door and to engage said metal block under force with said frictional material to create a frictional force between said arm member and metal block at every relative position thereof, whereby, said arm member, resilient member and metal block cooperate to provide a frictional hold open force to retain said door in an infinite number of hold open positions, while said non-conductive frictional material and resilient member also cooperate to insulate said hold open mechanism from electrostatic charge to allow it to be assembled to said body structure and door prior to being coated.

3. A friction type door hold open mechanism for a vehicle or the like having an electrically conductive body structure for retaining an electrically conductive door or the like hingedly mounted to said body structure in an infinite number of hold open positions, said mechanism being capable of being assembled to said body structure and door prior to said body structure and door being coated by a process in which said body structure and door are subjected to an electrostatic charge, comprising;

a pair of electrically non-conductive resilient members adapted to be secured to one of said body structure and door in opposed relation, a pair of metal blocks, one secured to each of said resilient members in opposed relation so as to be electrically insulated from one of said body structure and door, and, an arm member adapted to be secured to the other of said body structure and door including an electrically non-conductive frictional material molded thereto with an optimal configuration and length so as to slide between said metal blocks and compress said resilient elements to create a desired frictional force between said arm member and metal blocks at every relative position thereof as said door is moved to said hold open positions, whereby, said arm member, resilient members, and metal blocks cooperate to provide a frictional hold open force to retain said door in an infinite number of hold open positions, while said non-conductive frictional material and resilient members also cooperate to insulate said hold open mechanism from electrostatic charge to allow it to be assembled to said body structure and door prior to being coated.

* * * * *